US005444996A

United States Patent [19]

Joslin et al.

[11] Patent Number: 5,444,996

[45] Date of Patent: Aug. 29, 1995

[54] WASHER AND DRYER COMMUNICATION

[75] Inventors: Daniel F. Joslin, Sartell, Minn.; Daniel J. Ryherd, Webster City, Iowa

[73] Assignee: White Consolidated Industries, Inc., Cleveland, Ohio

[21] Appl. No.: 275,624

[22] Filed: Jul. 14, 1994

[51] Int. Cl.[6] ..... D06F 33/02

[52] U.S. Cl. ..... 68/12.04; 68/12.07; 68/12.15; 68/19.2

[58] Field of Search ..... 68/19.2, 20, 23 R, 12.04, 68/12.07, 12.15

[56] References Cited

U.S. PATENT DOCUMENTS

| | | | |
|---|---|---|---|
| 2,932,961 | 4/1960 | Robbins et al. . | |
| 3,531,791 | 6/1968 | Wells . | |
| 3,540,241 | 11/1970 | Jacobs . | |
| 3,824,813 | 7/1974 | Davis . | |
| 4,335,591 | 6/1982 | Gillespie . | |
| 4,390,965 | 6/1983 | Albert . | |
| 4,510,778 | 4/1985 | Cotton | 68/20 |
| 4,812,963 | 3/1989 | Albrecht et al. . | |
| 4,916,439 | 4/1990 | Estes et al. . | |

FOREIGN PATENT DOCUMENTS

| | | | |
|---|---|---|---|
| 91336 | 10/1983 | France | 68/12.07 |
| 2635539 | 2/1990 | France | 68/12.07 |
| 61-115600 | 2/1986 | Japan | 68/12.07 |
| 1-192395 | 8/1989 | Japan | 68/12.07 |
| 4-187178 | 7/1992 | Japan | 68/12.07 |

*Primary Examiner*—Frankie L. Stinson

*Attorney, Agent, or Firm*—Pearne, Gordon, McCoy & Granger

[57] ABSTRACT

A communications channel is provided between a washer and a dryer. When the dryer is drying, a signal is sent to the washer to extend the final spin operation in order to continue to mechanically remove water While the dryer operation continues. Fabric type information and fabric quantity information for a load are provided from the washer to the dryer. This information is used to indicate an estimated drying time for the load and to set the dryer fabric type selection.

6 Claims, 2 Drawing Sheets

WASHER AND DRYER COMMUNICATION

BACKGROUND OF THE INVENTION

The present invention relates to the control of fabric washers and dryers and, more particularly, to communication therebetween.

Washers for clothes and other fabric loads have become more sophisticated over the years. Washers typically provide a wash cycle that includes filling the tub with water, agitating the load in water and detergent, emptying the tub of water and detergent, spinning the tub to further remove water and detergent from the load, filling the tub with water, agitating the load in water, emptying the tub of water, and performing a final spin operation to remove water from the load.

The washer often selects water temperature, the length of each operation in the wash cycle, the insertion of additional operations (e.g., cool down), and, perhaps, motor speed, all on the basis of a fabric type selection made on a fabric type selector on the washer.

In some cases, the quantity of fabric in the load is determined and used to determine such factors as desired fill height and the intervals for each operation of the wash cycle. The quantity of fabric has been determined from such direct methods as weighing the mass of the load and from indirect methods such as measuring the rate at which the tub initially fills with water.

Dryers for clothes and other fabric loads have also become more sophisticated. Dryers typically provide a drying cycle that includes a drying operation in which the load is tumbled while hot air passes through the fabric. This operation often includes a non-heated portion at the end in which fabrics are allowed to cool down. Many dryers also provide some kind of post-drying operation that minimizes wrinkles in the fabric, such as periodically tumbling the load. The temperature and timing of the drying cycle are often determined according to a fabric type selector on the dryer.

Dryers have also been provided with various techniques for estimating the time required to dry the load. These techniques include measuring the rate of change in humidity in the load, measuring the exhaust air temperature profile and others.

SUMMARY OF THE INVENTION

A communication and control system for a fabric washer and a fabric dryer that improves the ease of use and efficiency of operation is provided. The system includes a dryer controller having an output indicative of when the dryer is drying, a washer controller for controlling a washing cycle, where the cycle includes a final spin operation, and a communications channel between the controllers. The channel communicates the dryer controller output to the washer controller and the washer controller extends the final spin operation beyond an initial length in response to the output indicating the dryer is drying.

The system may also include a fabric type selector on the washer, where the washer controller determines the operating parameters of the washer in response to the selector, and the communications channel communicates the fabric type selection from the washer controller to the dryer controller. The dryer controller determines the operating parameters of the dryer in response to the fabric type selection.

In addition, the system can include a mass measuring system communicating with the washer controller, where the measuring system measures a mass for a given load of fabric, and a drying time indicator on the dryer. The washer controller communicates the mass to the dryer controller over the channel and the dryer controller provides a drying time estimate to the indicator in response to the fabric type selection and the mass.

DESCRIPTION OF THE PREFERRED EMBODIMENTS

Figure 1:
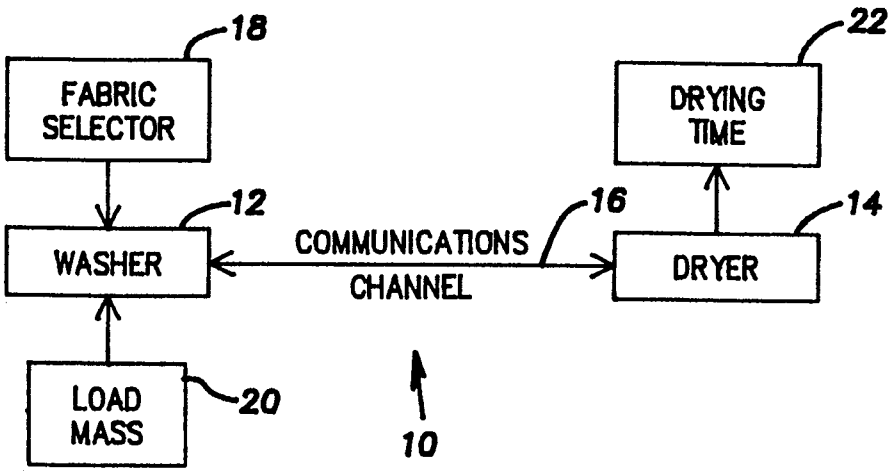
FIG. 1 is a block diagram of a system according to the invention.

Referring to FIG. 1, a communication and control system 10 for a fabric washer 12 and a fabric dryer 14 includes a communications channel 16 between the washer 12 and the dryer 14. The communications channel 16 may be, for example, hard-wired, an infra-red or radio frequency wireless link, or a power line impressed carrier signal. The washer 12 and dryer 14 each include a controller which may be, for example, a mechanical timer or an integrated circuit programmable controller such as a microprocessor.

The washer 12 is provided with a user-operated fabric selector 18 and a load mass device 20 for measuring the mass of a load of fabric to be washed. The washer fabric selector switch 18 may be, for example, a rotary selector switch, push button switches, or membrane switches. As is well-known in the art, operation of the washer fabric selection switch 18 may determine the operating parameters of the washer 12, such as water temperature, wash and rinse times, and spin speeds. The load mass device 20 may be, for example, a weighing device that actual measures the mass of the fabric (e.g., weighs the spin tub, transmission and fabric load and subtracts the mass of the tub and transmission) or a device that measures times associated with filling the tub with water and estimates the load mass therefrom. The initial fill time can provide a measure of dry mass and subsequent fill times can provide a measure of wet mass.

In operation, the status of the washer fabric selector 18 is provided not only to the washer 12 but also via the communication channel 16 to the dryer 14. In response to the washer fabric selector 18 being set for the washing of a load, the dryer 14 adjusts the temperature and timing of the drying cycle for the same load of fabric after it is transferred from the washer 12 to the dryer 14. This allows the user or operator to set the fabric type for a load of fabric in one step, rather than having to set it both on the washer and the dryer.

The load mass device 20 measures the mass of the fabric load in the washer 12. The measured mass is provided by the communications channel 16 to the dryer 14. The dryer 14 uses the mass from the washer 12 (and the setting of the fabric selector 18) to calculate an estimated drying time for the load. This estimated drying time is displayed on a drying time indicator 22 located on the dryer 14. It is well-known that the dry mass of a load of fabric can be used to estimate the drying time of the load. It is also possible to compare the dry mass and wet mass to determine water content for providing a more accurate estimate of drying time based on both the quantity of fabric and the water content thereof.

The invention provides an estimate of drying time to the user or operator that is based on actual load characteristics rather than on an arbitrary timer or temperature/humidity measurements.

The final spin operation of the washer 12 is used to extract water from the fabric load prior to drying. In general, it is at least initially more energy efficient to remove the water with this spin than it is to use an electric dryer. In the past, a compromise was made between removing the water by spinning the load in the washer 12 for a given time and the faster operation of drying (heating) the load in the dryer 14. However, when the dryer 14 is already drying a first load, there is no time advantage to ending the final spin operation of the washer 12 early (assuming only one dryer is available).

The communications and control system 10 of the invention allows the water removal process to be optimized. When the dryer 14 is drying, the controller in the dryer 14 provides a drying indicative signal to the controller in the washer 12 via the communications channel 16.

Figure 2:
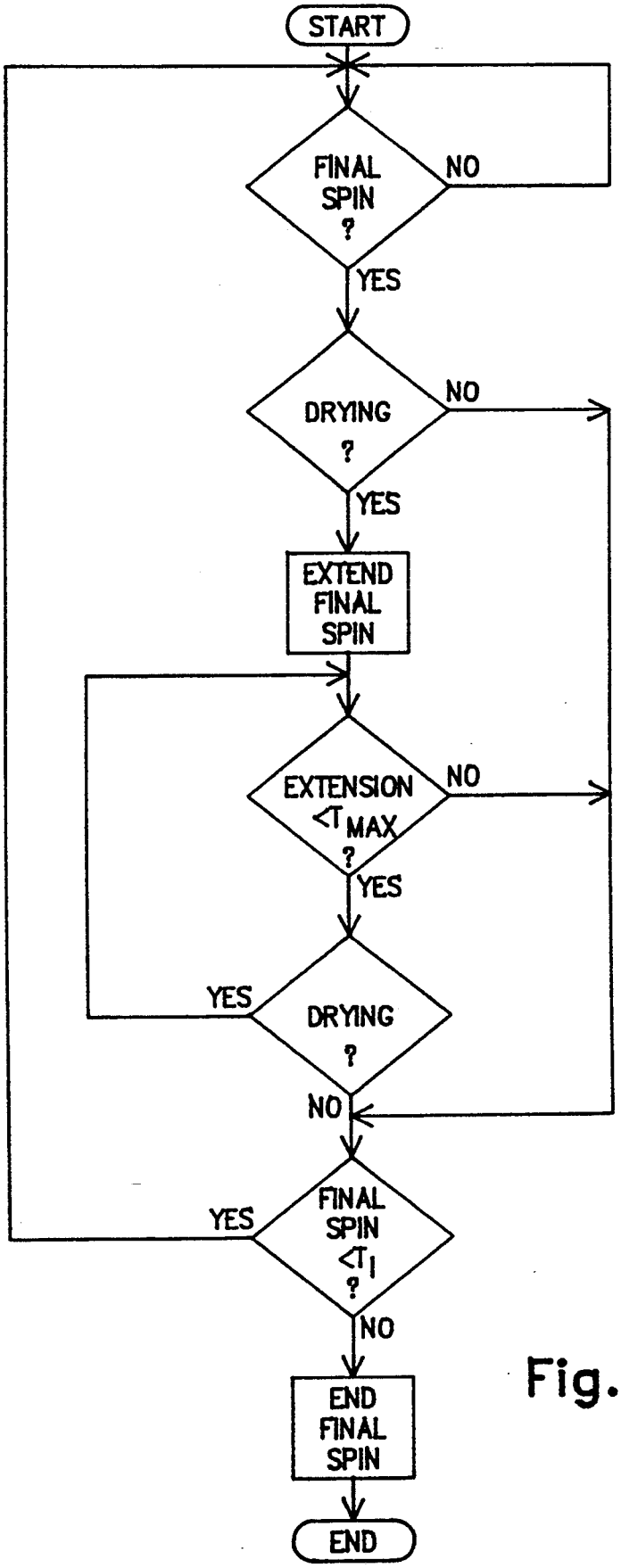
FIG. 2 is a flow chart diagram of a method according to the invention.

Referring to FIG. 2, if the washer 12 is in a final spin operation, the controller in the washer 10 checks for the drying indication signal. If the drying signal is absent, the washer 12 performs a normal length final spin operation of $T_1$. (e.g., 5 minutes) If the drying signal is present, the spin is extended.

If the extended time is less than a maximum value $T_{MAX}$ (e.g., 15 minutes), the final spin is extended as long as the drying signal is present. If the extended time is equal to or greater than $T_{MAX}$, the extension is ended, but the spin operation lasts for at least $T_1$.

The invention allows the washer 12 to continue to extract water from a second load of fabric by spinning while the dryer 14 is drying the first load of fabric. The second load is then dryer when its turn comes in the dryer 14. This allows energy usage to be minimized while decreasing the time it takes to wash and dry two or more loads.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed:

1. A method for controlling a fabric washer and a fabric dryer, said method comprising:

sensing if said dryer is in operation drying a first load of fabric;

providing a signal indicative of said dryer operation;

sensing if said washer is in a final spin operation spinning a second load of fabric, said final spin operation having an .initial length;

providing a signal indicative of said washer operation; and extending said final spin operation beyond said initial length in response to said washer and dryer operation signals.

2. A method according to claim 1, wherein said final spin operation extension is ended in response to an absence of said dryer operation signal.

3. A method according to claim 1, wherein said initial length is extended by less than a maximum amount.

4. A communication and control system for a fabric washer and a fabric dryer, said system comprising:

a dryer controller having an output indicative of when said dryer is drying;

a washer controller, said washer controller controlling a washing cycle, said cycle including a final spin operation; and a communications channel between said controllers, said channel communicating said dryer controller output to said washer controller, said washer controller extending said final spin operation beyond an initial length in response to said output indicating said dryer is drying.

5. A system according to claim 4, wherein said final spin operation extension is ended in response to an absence of said output indicating said dryer is drying.

6. A system according to claim 4, wherein said initial length is extended by less than a maximum amount.

* * * * *